US007686700B2

(12) United States Patent
Del Raso

(10) Patent No.: US 7,686,700 B2
(45) Date of Patent: Mar. 30, 2010

(54) LASER AIMING GOLF CLUB

(76) Inventor: Americo Del Raso, 21858 River Oaks Dr., Apt. 3F, Rocky River, OH (US) 44116

( * ) Notice: Subject to any disclaimer, the term of this patent is extended or adjusted under 35 U.S.C. 154(b) by 121 days.

(21) Appl. No.: 11/836,084

(22) Filed: Aug. 8, 2007

(65) Prior Publication Data

US 2008/0248889 A1 Oct. 9, 2008

Related U.S. Application Data

(60) Provisional application No. 60/842,539, filed on Sep. 6, 2006, provisional application No. 60/836,749, filed on Aug. 11, 2006.

(51) Int. Cl.
*A63B 69/36* (2006.01)

(52) U.S. Cl. ..... 473/220; 473/221

(58) Field of Classification Search ..... 473/219, 473/220, 221, 222, 223, 226
See application file for complete search history.

(56) References Cited

U.S. PATENT DOCUMENTS

| | | | | | |
|---|---|---|---|---|---|
| 5,029,868 | A * | 7/1991 | Cloud | ..... | 473/220 |
| 5,165,691 | A * | 11/1992 | Cook | ..... | 473/220 |
| 5,169,151 | A * | 12/1992 | Conley | ..... | 473/220 |
| 5,374,063 | A * | 12/1994 | Ogden | ..... | 473/220 |
| 5,707,296 | A * | 1/1998 | Hodgson et al. | ..... | 473/220 |
| 2007/0167248 | A1 * | 7/2007 | Fler et al. | ..... | 473/220 |

* cited by examiner

*Primary Examiner*—Nini Legesse
(74) *Attorney, Agent, or Firm*—John D. Gugliotta, PE, Esq.

(57) ABSTRACT

A golf club utilizing a columnated beam of light for providing a guiding target, all incorporated into a golf club, having a switch that de-actuates when the club handle is dropped or rotated to a position in excess of a predetermined safe angle from vertical. Such a system to be utilized in a practical, repeatable fashion during ball address and stroke, while preventing errant light tracing during follow through. The instant abstract is neither intended to define the invention disclosed in this specification nor intended to limit the scope of the invention in any way.

17 Claims, 8 Drawing Sheets

LASER AIMING GOLF CLUB

RELATED APPLICATIONS

This application claims priority of provisional applications Ser. No. 60/842,539 filed on Sep. 6, 2006 and Ser. No. 60/836,749 filed on Aug. 11, 2006.

BACKGROUND OF THE INVENTION

1. Field of the Invention

This invention relates to golf clubs and, more specifically, to a golf club putter with an improved laser aiming system incorporated therein.

2. Description of the Related Art

There are currently a number of golf club putters that incorporate aiming assist devices. The shear number demonstrates the need and benefit of such a system. However, none of these devices as developed are capable of adapting a laser aiming system during the use of the club during its stroke.

For example, the following references all disclose golf club putters incorporating some form of laser actuated guiding or aiming system:

U.S. Pat. No. 5,464,221, issued in the name of Carney;

U.S. Pat. No. 5,527,041, issued in the name of Terry, III, et al;

U.S. Pat. No. 5,707,296, issued in the name of Hodgson et al;

U.S. Pat. No. 5,980,393, issued in the name of Molinaroli et al.;

U.S. Pat. No. 5,435,562, issued in the name of Stock et al.; and

U.S. Patent Publication US200/0261072, published in the name of Adams.

However, while all of these references describe a method and means of utilizing a columnated beam of light for providing a guiding target, all incorporated into a golf club, none of these reference address the specific improvements of the present invention that allow such a system to be utilized in a practical, repeatable fashion during ball address and stroke, while preventing errant light tracing during follow through.

SUMMARY OF THE INVENTION

It is therefore an object of the present invention to provide an improved golf club with laser aiming system It is a feature of the present invention to provide an improved laser aiming system incorporated into the club head in a self-leveling manner.

It is a further feature of the present invention to provided an improved laser aiming system incorporating a handle mounted actuation switch that is self releasing during club follow through.

Briefly described according to the preferred embodiment of the present invention, a golf club with laser beam pointer is provided in which two pendulum mounted laser beam emitters are incorporated into the club head for emitting a pair of columnated beams of light, parallel to each other, perpendicular to the club striking face, and spaced apart such as to form a guide around either side of an addressed golf ball surrounding the club head "sweet spot". The light emitters are mounted in an inner club head assembly that is freely rotatable and counter weighted such as to cause the assembly to maintain a level attitude during the pendulum motion of the club stroke. In this manner, the targeting mechanism can be maintained during play. Additionally, a switch assembly incorporated in the handle operates the laser beam pointers during normal club gripping. An angular position mechanism causes an automatic shutoff of the laser beam emitters as the club shaft is diverted too far from perpendicular. In this manner, the columnated light is automatically shut off during club stroke follow through to prevent accidental targeting of or viewing by those around the user.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DETAILED DESCRIPTION OF THE PREFERRED EMBODIMENT

The best mode for carrying out the invention is presented in terms of its preferred embodiment, herein depicted within the Figures.

1. Club Head Improvements

Figure 1:
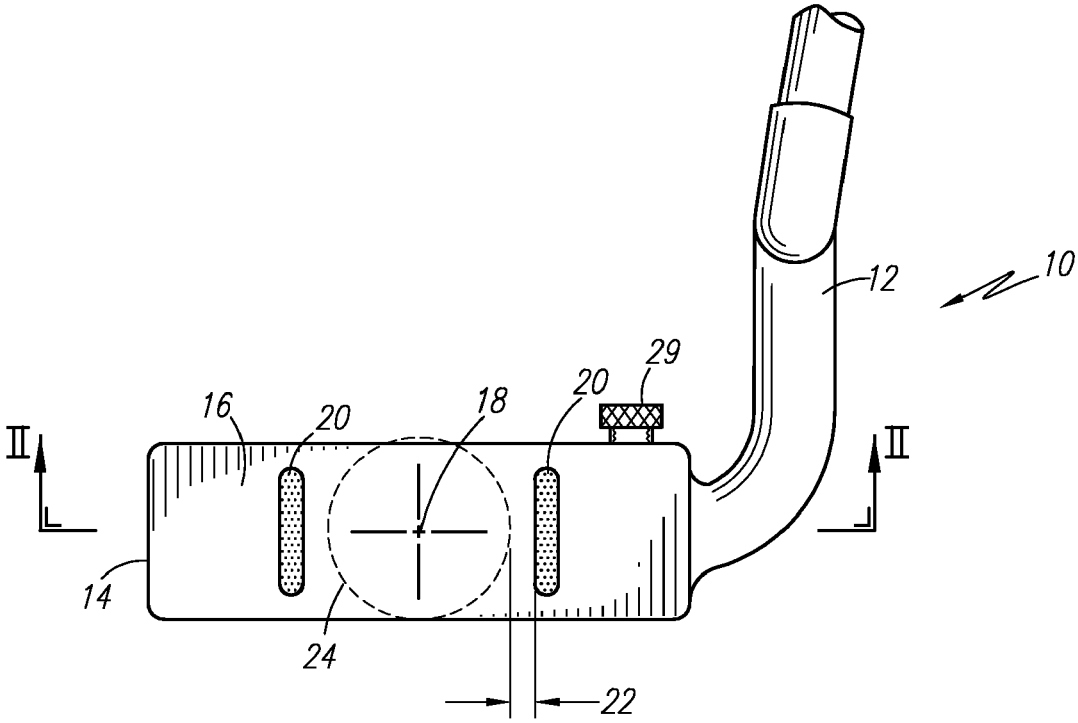
FIG. 1 is a partial front elevational view of a improved laser aiming golf club incorporating the preferred embodiment of the present invention.

Referring now to FIG. 1, an improved golf club, generally noted as 10, is provided having a handle 12 affixed to an improved club head 14 in an otherwise conventional manner. However, on the club head striking surface 16 is generally a preferred striking location, known as the "sweet spot" 18, and a pair of elongated apertures 20 are formed at an offset distance 22 to provided a clearance between a conventional golf ball (circumferences shown as 24) and the respective inner boundary of the elongated apertures 20.

Figure 2:
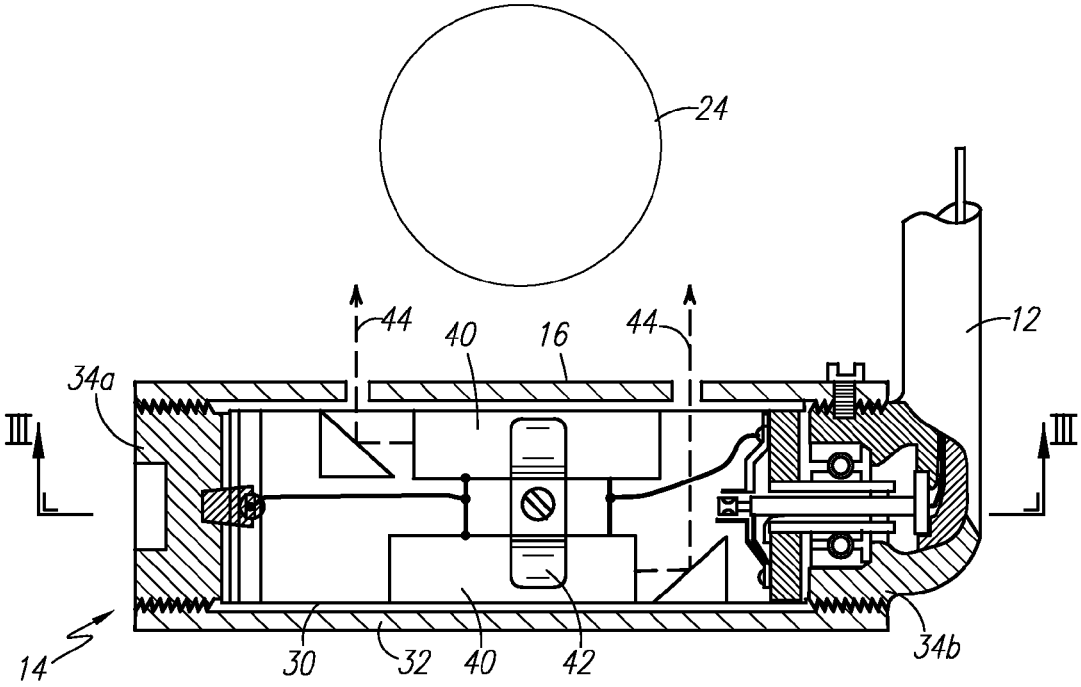
FIG. 2 is a cross sectional side elevation view taken along line II-II of FIG. 1.
Figure 3:
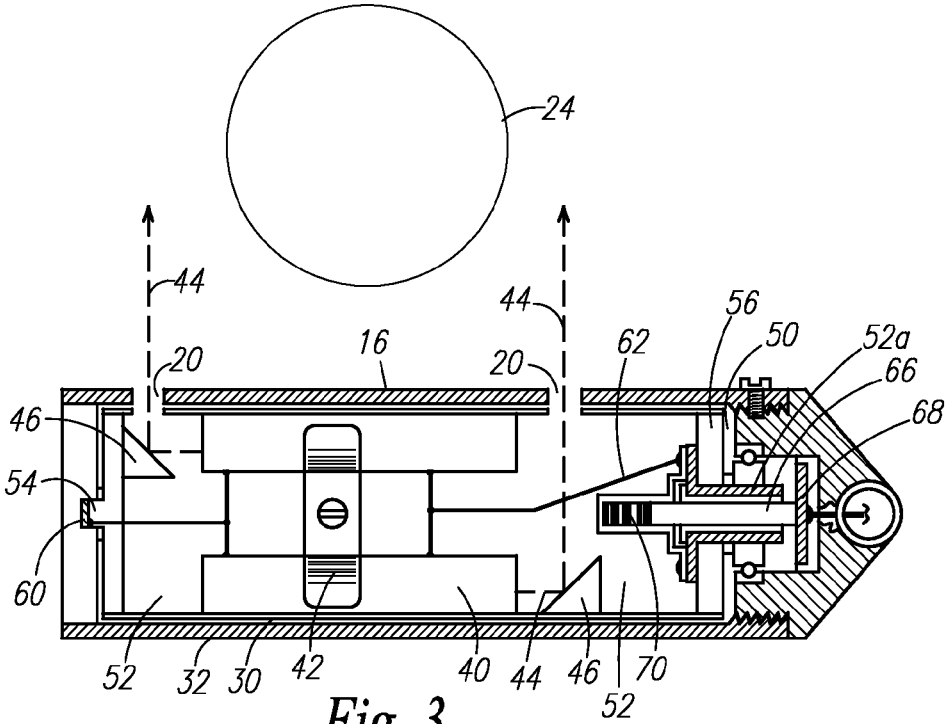
FIG. 3 is a partial cross sectional end view thereof.

As shown in conjunction with FIGS. 2 and 3, the club head 14 incorporates an inner assembly 30 mounted within an outer assembly 32. The outer assembly 32 forms the outer surface of the club head 14, and as such can be anticipated as containing any of the various and sundry other improvements available for improved golf club putters. However, the outer assembly 32 is hollow for receiving the inner assembly 30, and is enclosed by a first end plug 34A and a second end plug 34B, respectively. It is anticipated that each end plug 34 is threadingly engaged within the outer assembly to seal the formed inner chamber, but any other conventional means of attachment can also be utilized. The inner assembly 30 is anticipated as being freely rotatable within the inner chamber formed by the outer assembly 32 and houses a pair of laser beam emitter 40 mounted within and to the inner assembly 30 by a mounting bracket 42 which holds each laser beam emitter 40 securely in a fixed position such that a beam of columnated light 44 can be directed inward and outward, respectively. Each light beam 44 is directed toward a surface type mirror or prism 46 such that the light beam 44 is directed outward though the elongated openings 20 in a manner that the planar, vertical beam in a manner that thereby impinges on the ground on each side of the addressed golf ball 24.

Referring now in conjunction with FIG. 3, an end view is shown for greater clarity in which the club head 14 having a striking surface 16 is addressed to a golf ball 24. The club head 14 has an inner assembly 30 housed within an outer assembly 32 and having an offset 50 to allow the inner assembly 30 to freely rotate within the cavity formed by the outer assembly. A counterweight 52 keeps the inner assembly in a relatively level attitude during the pendulum motion normally imparted to the outer assembly 32 by the handle 12. In this manner, the laser emitters 40 can direct a planar beam of light 44 consistently, reflected off the mirror or prism 4 and through the elongated aperture 20 in a manner that the planar, vertical beam in a manner that thereby impinges on the ground on each side of the addressed golf ball 24.

As just described above, the rotating inner assembly pivots within the outer assembly (which forms the club head) and remains in a relatively level attitude, and represents a major improvement of the present invention. While the mechanism for powering the laser beam emitters 40 and allowing for the pivoting/rotating motion of the inner assembly 30 does not need to be restricted, for purposes of providing an enabling disclosure a preferred embodiment of such means shall be provided such that one skilled in the art can be reasonably taught to practice the improvements of the present invention. As such, the pivoting and rotatablility of the inner assembly 30 can be accomplished by providing a tubular support sleeve 52 and a central hub 54 formed at each end of the inner assembly 30 are centrally aligned such as to form an axle upon which the inner assembly can rotate. This requires clearance 50 on all sides between the outer surface of the inner assembly and the inner surface of the chamber formed by the outer assembly. Further, to allow for easier movement with reduced friction, ball bearings 56 or the like can be employed as well between the sleeve 52 and hub 54 and their supports can be employed.

Finally, communication and control of electrical power must be provided to the laser beam emitters 40 remotely from the handle 12. Shown to accomplish this, a means for communicating electrical connections through a pivoting assembly is employed in which a the housing of the inner assembly is nonconductive, such as being formed of a plastic material, with electrical connections being provided on either end. At the outer end, an electrical contact 60 is in communication with one pole of a battery through a conductor attached through the hub 54. At the end, an electrical conduit 62 in communication with the opposite pole of a battery is conducted though a brush 66 and commutator 68 (shown as a metal disc) at the inner end of the assembly. A spring 70, to provide sufficient pressure to allow the brush 66 to maintain constant electrical contact with the commutator 68, thereby allows for an electrical circuit to be communicated to the club head 14 from the shaft 12 in order to power and control the laser emitters 40 in a manner that still allows the inner assembly 30 to maintain a level attitude, even with a pendulum motion imparted to the club 10.

Such a mechanism is provided as way of an exemplary enabling disclosure, and is not meant to limit the present invention.

Figure 13:
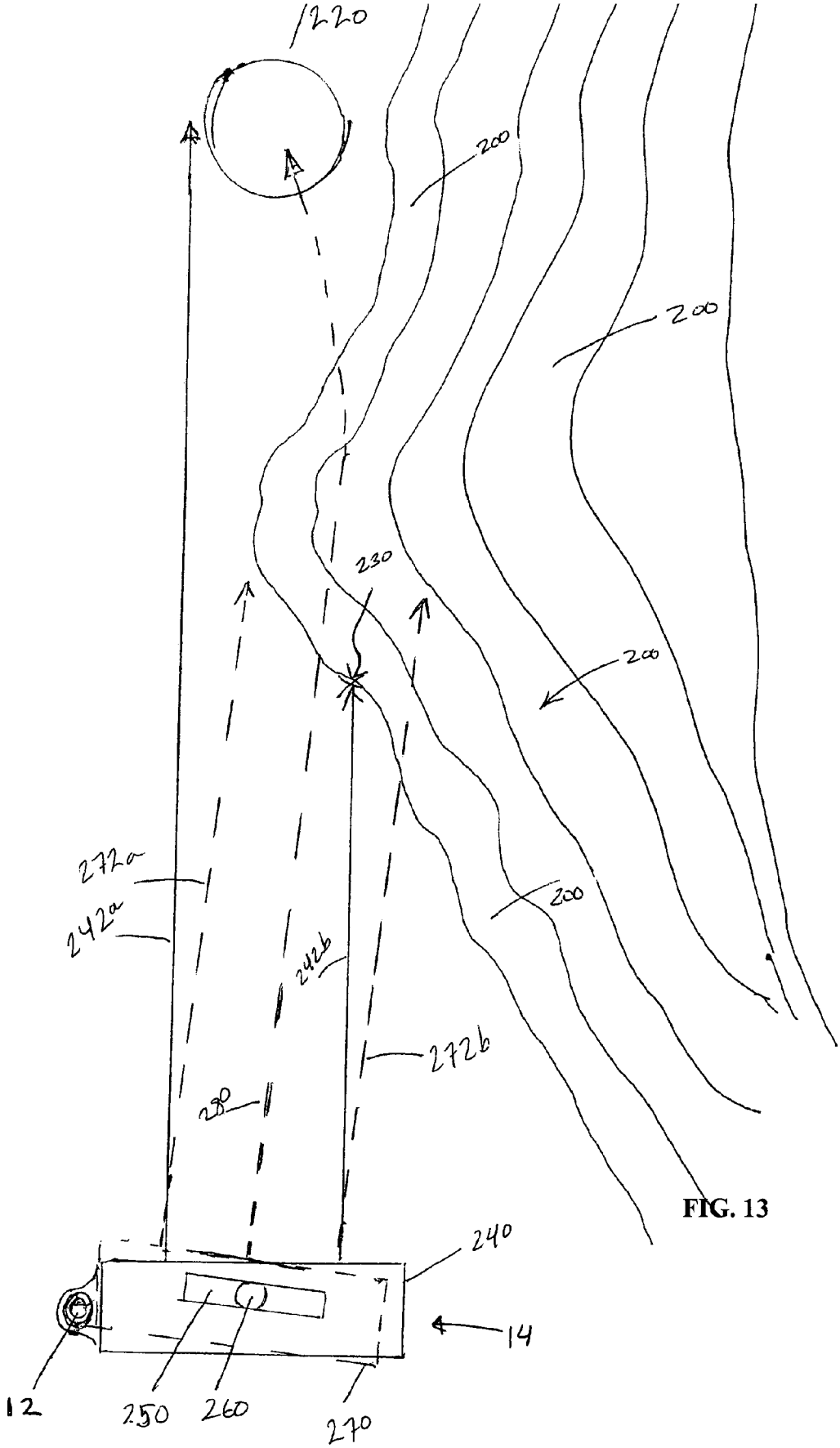

An operational diagram of the putter head 14 utilized on a modestly sloped green is shown in FIG. 13. A rise in the slope 200 is shown to obstruct a direct path between the putter head 14 and the cup 220. This obstruction 230 is more clearly shown when the putter head 14 is positioned at the initial address configuration 240, wherein a first parallel beam 242*a*, closest to the handle 12, illuminates a direct path to the cup 220, but a second parallel beam 242*b* is obstructed by the elevation 200. The golfer refers to a bubble level indicator 250 to reposition the head 12 to a position that is most likely to achieve a successful shot. The golfer is guided by a bubble level 260 in the bubble indicator 250. The golfer aims to adjust the head 14 to a position that centers the bubble 260. When the bubble 260 centers, a final address configuration 270 is achieved. As can be shown in the diagram, The parallel beams 272*a*, 272*b* don't guide the golfer towards a cup 220, but they rather illuminate a best path 278 to it. Essentially, the adjusted beams 272*a*, 272*b* direct the golfer to the path 278 that compensates for the rise in the slope 200.

2. Club Handle/Switching Improvements

Figure 4:
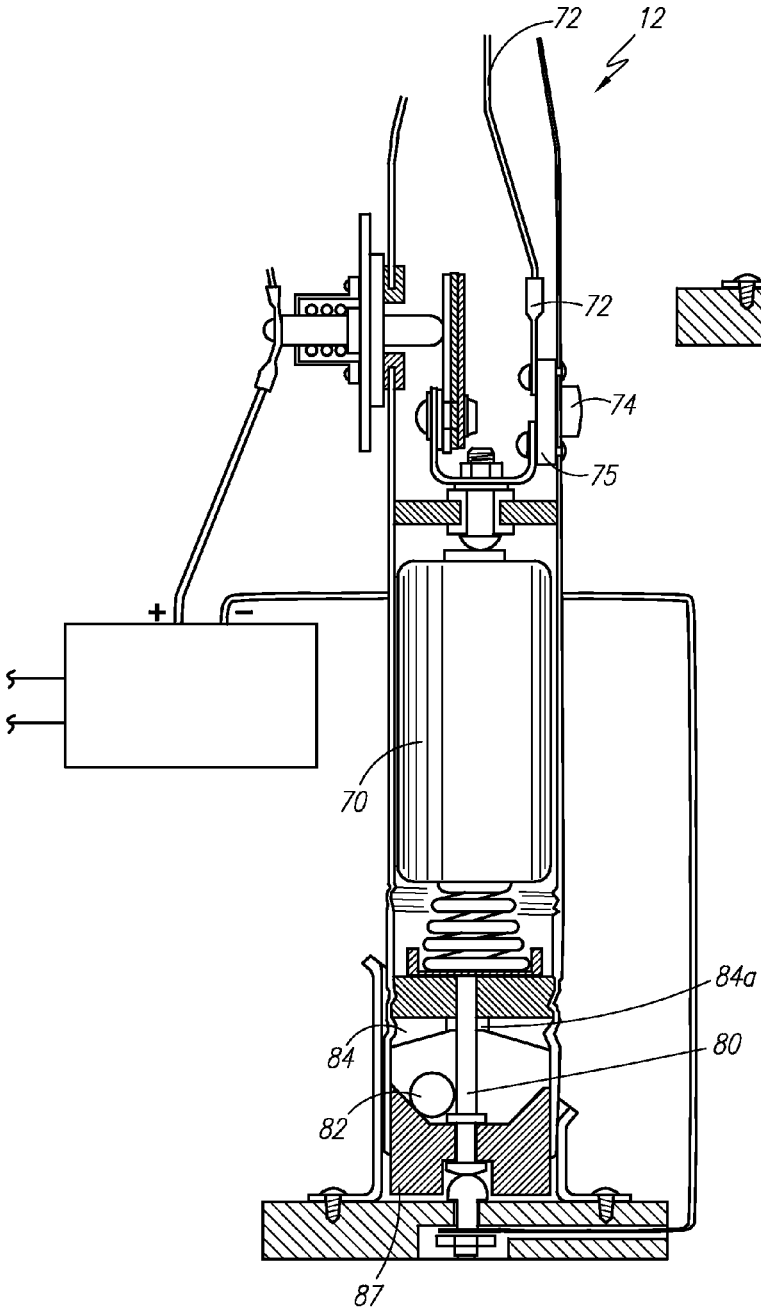
FIG. 4 is a cross sectional elevational view of a golf club handling incorporating a switching and power means for use therewith.
Figure 5:
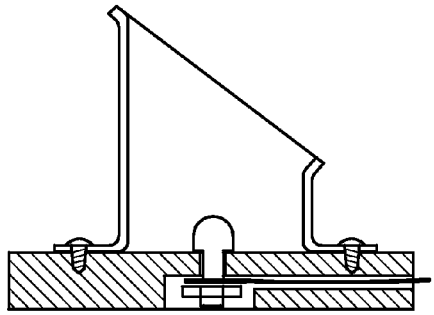
FIG. 5 is a cross sectional view of a battery charger mechanism, as shown in FIG. 4.

Referring now to FIGS. 4 and 5, the handle 12 is anticipated as forming an inner cavity containing a power source, such as a battery 70, in electrical communication with the club head 14 through a conductor 72 in contact with one pole of the battery 70, and while a parallel conductor can be utilizes in contact with the opposite pole, if the handle 12 is formed of a ferrous material the shaft itself can equally function to complete an electrical circuit. A push button 74 operatively connected to a laser emitter operating switch 75 is then pressed to reset the laser beam emitters.

A position switching means is also anticipated as being used at the upper end of the club handle. This allows the electrical circuit to be complete when the shaft is in a proper vertical position within a certain angular range from vertical, but disconnects the circuit, opening the switch, when the shaft is pivoted outside such a range. As shown, this is implemented by the use of a central electrical contact 80 made from a nonmagnetic material, but being a good electrical conductor mounted centrally through the handle and in communication with the battery. A ball 82, made of a magnetizable and electrically conductive material, is further provided in the vicinity of the contact 80. A solid washer 84 is further provided have an aperture at its center that allows free access 84*a* to the electrical contact 80, and having one flats side and an opposite side with a slope 86. It is anticipated that this washer is made of brass, copper or aluminum. In this manner, the magnetizable ball 82, when attracted to the central contact 80 will bridge the gap between the contact 80 and the washer 84, thereby completing the circuit. This can be caused to happen by a spring returned pushbutton 88 urging the ball 82 into such a position. The attraction of the ball 82 to the contact 80, however, must not be so strong as to overcome gravity when the shaft is pivoted to a horizontal or near horizontal position. In such a condition, it is anticipated that the ball 82 will fall and thereby break the electrical circuit, causing the switch to be reset.

As further shown in FIG. 5 is a recharger 90, specifically adapted to maintain an electrical connection through the resettable switching means described above, while charging the battery in an otherwise conventional manner. Such a mechanism is provided as way of an exemplary enabling disclosure, and is not meant to limit the present invention.

3. Additional Feature of Laser Beam Elevation Control

Figure 10:
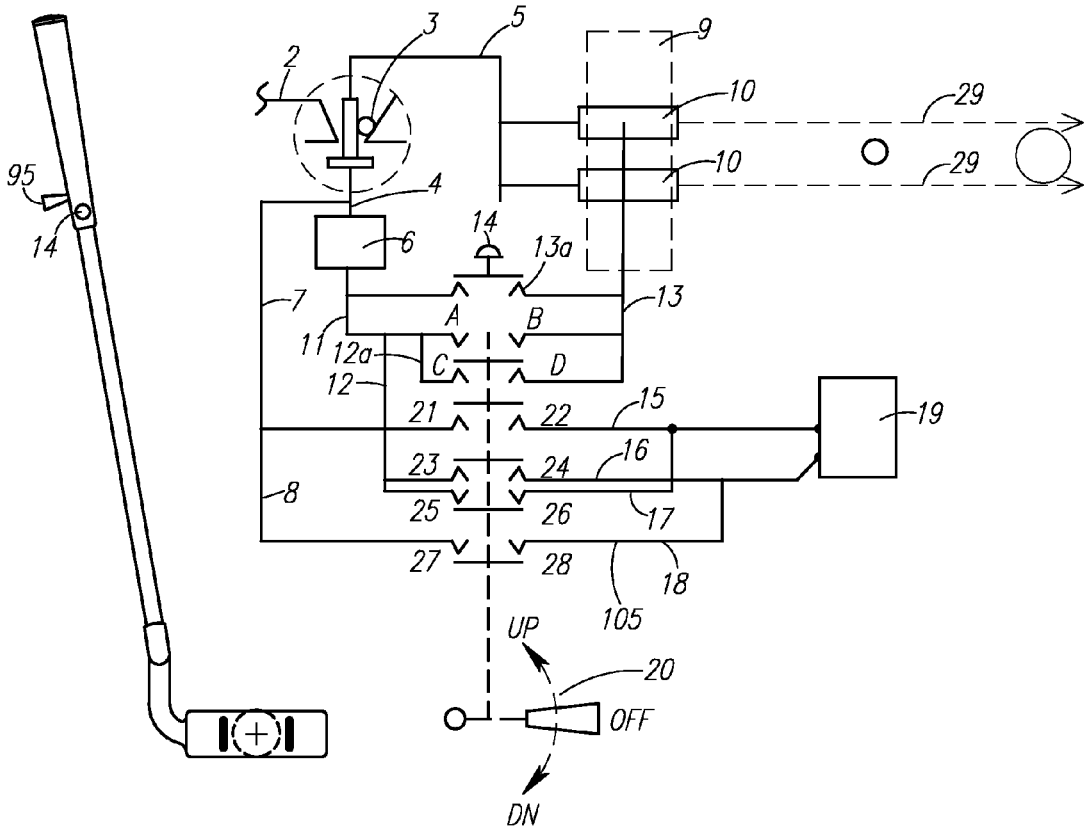
FIG. 10 is a schematic depiction of the laser elevation control.

Referring now to FIG. 10 which shows the configuration of the club with the ability to compensate for a sloped putting area. The club head 14 may be configured with a selector switch 95 that allows the lasers beam emitters 40 to be moved up or down. The selector switch 95 controls a motor 100 that is capable of raising or lowing the laser beam emitters 40. The motor 100 connects to electrical lines 105, which are configured to allow the motor 100 to function based on the user's selection through closing open circuits to enable functionality. The motor 100 is preferably powered by the battery 70.

Figure 11:
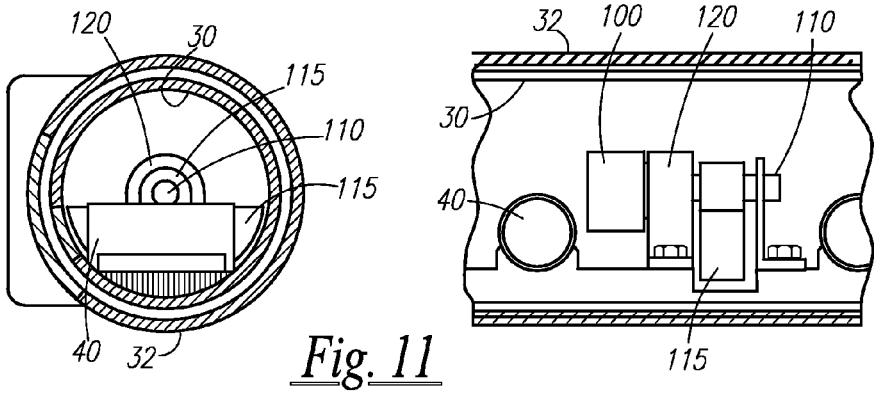
FIG. 11 is a cross-sectional view of the laser elevation control mechanism.

Referring now to FIG. 11, the motor 100 is showed in conjunction with the laser beam emitter 40. A support shaft 110 is connected to the motor 100 that rotates based on the selection made with the selector switch 95. An electronically controlled pendulum 115 and a pendulum gear box 120 are also attached to the support shaft 110 to control the laser beam emitter 40. The motor 100 rotates the support shaft 110 which through the electronically controlled pendulum 115 and the pendulum gear box 120 shifts the laser emitter up or down based on the selection of the user.

Figure 12A:
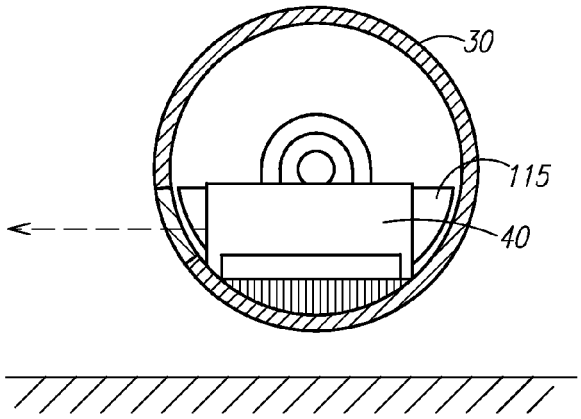
FIG. 12*a* is a partial side view of the emitter and outer assembly in the parallel position.
Figure 12B:
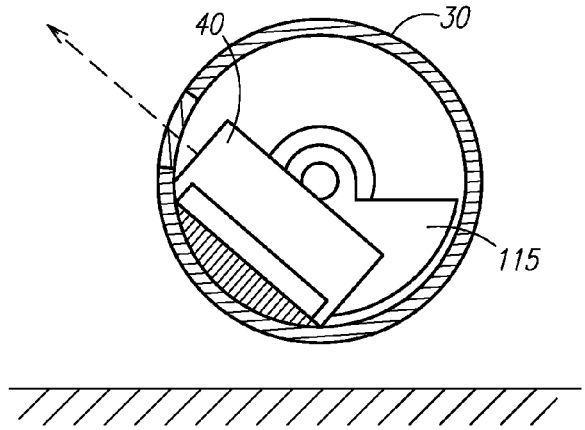
FIG. 12*b* is a partial side view of the emitter and outer assembly in the upward position.
Figure 12C:
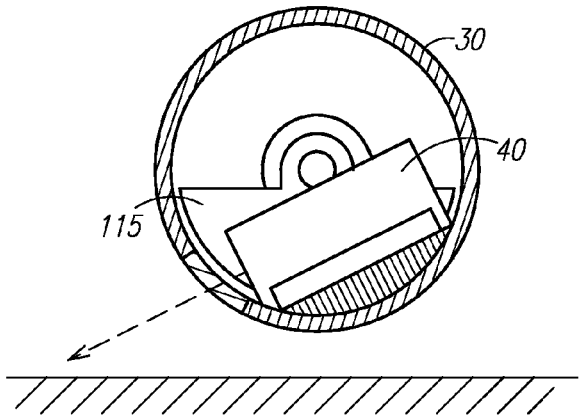
FIG. 12*c* is a partial side view of the emitter and outer assembly in the downward position; and, FIG. 13 is an operational diagram of the present putter utilized on an uneven green.

Referring now to FIGS. 12*a*, 12*b*, and 12*c*, the laser beam emitter 40 and outer assembly 32 is showed in the parallel, upper, and lower positions respectively. FIG. 12*a* shows the laser beam emitter 40 and outer assembly 32 in the parallel position. FIG. 12*b* shows the laser beam emitter 40 and outer assembly 32 in the upward position. FIG. 12*c* shows the laser beam emitter 40 and outer assembly 32 in the downward position. Each of these figures show the laser emitter pivoted off the support shaft.

OPERATION OF THE PREFERRED EMBODIMENT

Figure 6:
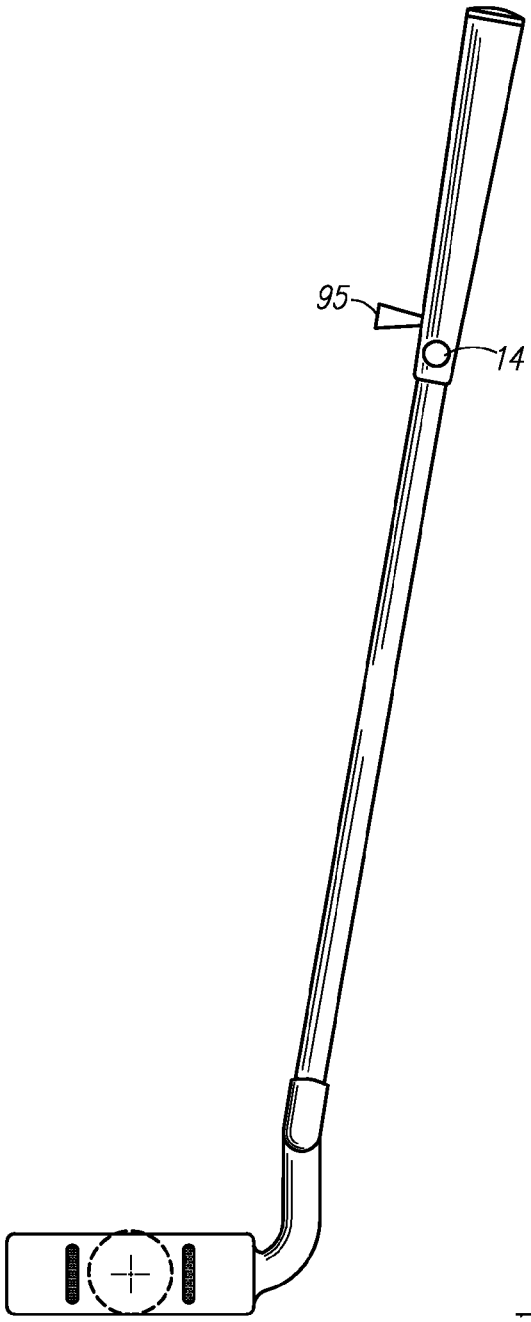
FIG. 6 is a front elevational view of an improved laser aiming golf club incorporating the preferred embodiment of the present invention.
Figure 7:
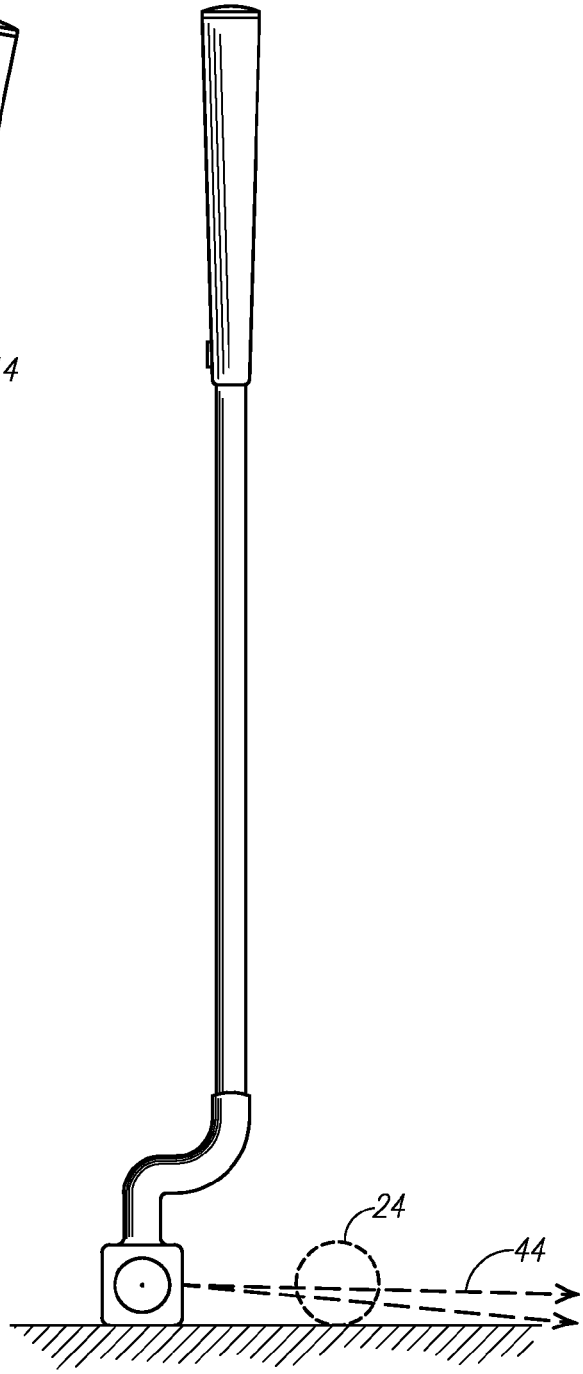
FIG. 7 is a side elevational view thereof.
Figure 8:
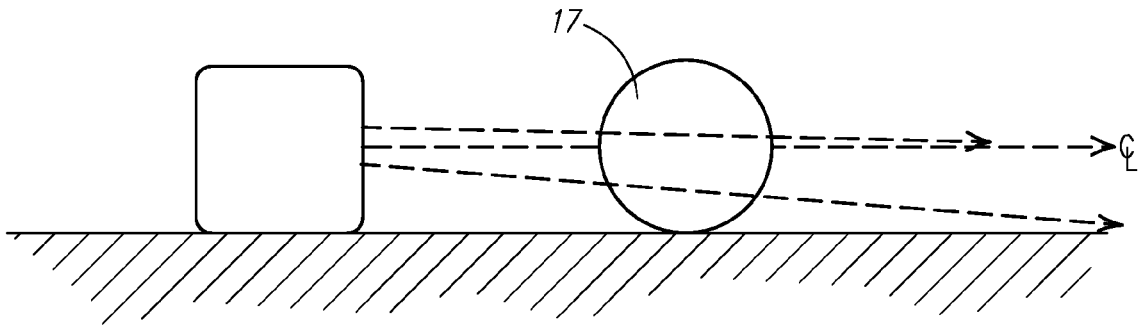
FIG. 8 is a partial detailed side elevational view shown in use.
Figure 9:
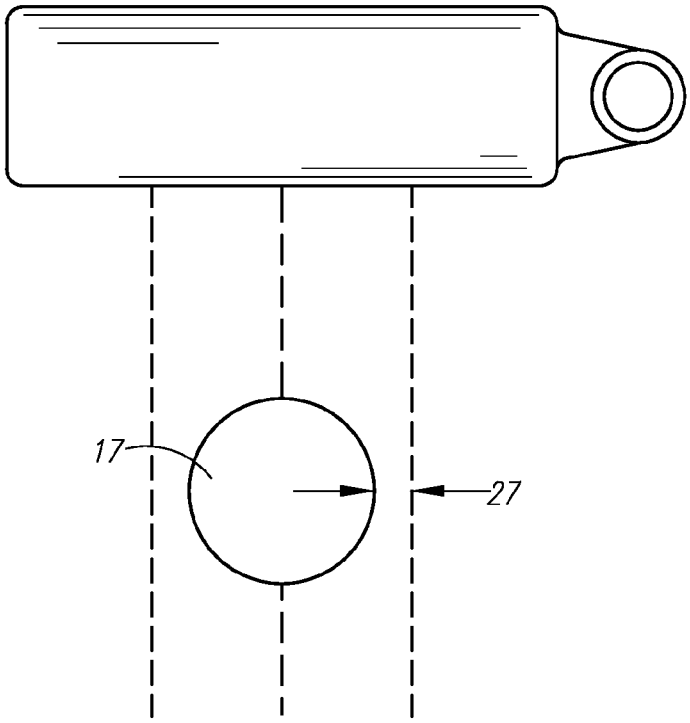
FIG. 9 is a partial detailed top plan view shown in use.

In accordance with a preferred embodiment of the present invention, as shown in FIGS. 6 though 9, to use the present invention the ball is addressed and the club held in an otherwise conventional manner as shown. The switch is engaged and the laser emitters powered and activated. If the club handle exceeds a predetermine angle from vertical (anticipated as approximately twenty degrees from vertical) the laser emitters will shut off. Should the player droop the club, the like emitters will similarly shut off, assuring the safety of both players and observes. Such a safety feature, as implemented, will remain operative even if the main control switch has failed.

The user may also engage the laser elevator. This is typically done if the receiving cup is either obstructed or too low due to the slope of the green. The user will select to move the laser either up or down through the selector switch. The reversible motor will then move then rotate the support shaft which in turn moves the laser emitters and the dynamic platform to the user's desired position.

As shown and described, the present invention can be used to provide a visual aid to confirm the ball's intended track. Providing a pair of parallel light beams than intersect vertically with the ground, a "corridor" is shown.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is not intended that the scope of the invention be defined by the exemplary Claims appended hereto. Therefore, the scope of the invention is to be limited only broadly by the Specification, Drawings and their equivalents.

Having thus described the invention what is claimed as new and desired to be secured by Letters Patent is as follows:

1. A golf club comprising:

a putter head;

two pendulum-mounted laser beam emitters incorporated in said putter head, both of said pendulum-mounted laser beam emitters emitting columnated beams of light;

a switch assembly to operate said laser beams emitters, and a selector switch that is provided as a means to allow said laser beam emitters to move with respect to said putter head, wherein said selector switch controls a motor that is capable of moving the laser beam emitters.

2. The golf club of claim 1, wherein the laser beams emitted from said laser beam emitters are emitted parallel to one another and perpendicular to a striking face of said putter head.

3. The golf club of claim 2, wherein each beam of light is directed outward through an elongated opening extending though the face of said putter head in such a manner that a planar, vertical beam impinges on the ground on each side of an addressed golf ball.

4. The golf club of claim 1, wherein said laser beams emitted from said laser beam emitters are spaced apart on the preferred striking surface of said putter head such as to form a guide around the sides of an addressed golf ball.

5. The golf club of claim 1, wherein said putter head is hollow and wherein said laser beam emitters are mounted in an inner assembly that is received inside said hollow putter head such that said inner assembly is freely rotatable and counter weighted to maintain a level attitude during a pendulum motion of a stroke of said club.

6. The golf club of claim 5, further comprising a counterweight to keep said inner assembly level during a pendulum motion of the club stroke such that laser beam emitters direct a beams of light that are reflected off a mirror or a prism comprised on said inner assembly.

7. The golf club of claim 5, wherein said inner assembly comprises a tubular support sleeve and a central hub formed at each end of said inner assembly, said tubular support sleeve being centrally aligned to form an axle upon which said inner assembly can rotate.

8. The golf club of claim 5, wherein a clearance exists on all sides between said inner assembly and the interior of said hollow putter head.

9. The golf club of claim 8, wherein ball bearings are employed on said inner assembly between said tubular support sleeve and said central hub to reduce friction during the movement of said inner assembly.

10. The golf club of claim 8, wherein a communication and a control of electrical power is remotely provided to said laser beam emitters at a putter handle by means of an electrical connection through a pivoting assembly in which said inner assembly is nonconductive, wherein an electrical circuit is communicated to said putter head from a shaft in order to power and to control said laser beam emitters.

11. The golf club of claim 10, further comprising a position switching means at an upper end of said putter handle, said position switching means allows said electrical circuit to be complete when said shaft is in a proper vertical position and within a defined certain angular range from vertical, but it disconnects said circuit to open said switch when said shall is pivoted outside said range.

12. The golf club of claim 11, further comprising a ball made of a magnetizable and an electrically conductive material in a vicinity of an electrical contact, wherein said magnetizable ball completes the circuit when it gravitates to the central contact to bridge a gap between said central contact and a washer, wherein a spring returned pushbutton urges said ball into a position to cause it to complete a circuit.

13. The golf club of claim 1, wherein said hollow putter head further comprises at least one plug threadingly engaged with said hollow putter head such as to seal the interior of said hollow putter head.

14. The golf club of claim 1, wherein said motor connects to electrical lines to function by means of closing open circuits, a support shaft is connected to said motor and it rotates based on a selection made with said selector switch, said motor rotates said support shaft which moves said laser beam emitters by means of an electrically controlled pendulum and a pendulum gear box.

15. A golf club with laser beam pointers comprising two pendulum-mounted laser beam emitters incorporated into a club bead for emitting a pair of columnated beams of light, wherein the columnated beams of light are parallel to each other, perpendicular to the club striking face, and spaced apart such as to form a guide around either side of an addressed golf ball surrounding a preferred striking surface of a golf club head, wherein said club head is hollow and said laser beam emitters are mounted inside the club head such that they are freely rotatable and counter weighted, thereby causing the laser beam emitters to maintain a leveled attitude during the pendulum motion of the club stroke.

16. The golf club of claim 15, further comprising a safety switching means that automatically shuts off said laser beam emitters when the shaft of the club exceeds a predetermined angle relative to vertical in order to prevent accidental targeting of or viewing by those surrounding the golf club user.

17. The golf club of claim 15, wherein said laser beam emitters are mounted on an inner assembly that is adjustably counter weighted such as to cause the inner assembly to maintain an attitude at a selected angle relative to level during the pendulum motion of the club stroke.

* * * * *